US009863195B2

(12) United States Patent
Peer et al.

(10) Patent No.: US 9,863,195 B2
(45) Date of Patent: Jan. 9, 2018

(54) PASSIVE PRESSURE AND LOAD BALANCING BEARING

(71) Applicant: SMITH INTERNATIONAL, INC., Houston, TX (US)

(72) Inventors: Richard David Peer, Katy, TX (US); Huward Paul Fontenot, Jr., Spring, TX (US); Bastiaan Liezenberg, Sugar Land, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 14/892,982

(22) PCT Filed: Jun. 17, 2015

(86) PCT No.: PCT/US2015/036171
§ 371 (c)(1),
(2) Date: Nov. 20, 2015

(87) PCT Pub. No.: WO2015/195760
PCT Pub. Date: Dec. 23, 2015

(65) Prior Publication Data

US 2016/0194926 A1 Jul. 7, 2016

Related U.S. Application Data

(60) Provisional application No. 62/013,939, filed on Jun. 18, 2014.

(51) Int. Cl.
*E21B 21/00* (2006.01)
*E21B 3/04* (2006.01)
(Continued)

(52) U.S. Cl.
CPC ..... *E21B 21/00* (2013.01); *E21B 3/04* (2013.01); *E21B 4/003* (2013.01); *E21B 33/0415* (2013.01)

(58) Field of Classification Search
CPC . E21B 21/00; E21B 3/04; E21B 4/003; E21B 33/0451
See application file for complete search history.

(56) References Cited

U.S. PATENT DOCUMENTS 4,531,580 A 7/1985 Jones
6,354,385 B1 3/2002 Ford et al.
(Continued)

OTHER PUBLICATIONS

International Search Report for corresponding International App No. PCT/US2015/036171, dated Sep. 24, 2015, 4 pages.
(Continued)

*Primary Examiner* — Giovanna C Wright
*Assistant Examiner* — Brandon Duck
(74) *Attorney, Agent, or Firm* — David J. Smith

(57) ABSTRACT

Passive load balancing in a fluid bearing for a rotational device is provided using disclosed devices, systems, and methods. In particular, fluid bearing apparatus may include an outer member with an inner member disposed concentrically within the outer member. A fluid inlet may provide fluid communication with a surrounding space between the inner and outer members. A bearing may be connected to the inner member and may extend into the surrounding space. The apparatus may also include a piston located in the surrounding space between the bearing and the fluid inlet. A supporting fluid is located between the piston and a surface of the bearing to transmit force from the piston to the bearing.

19 Claims, 7 Drawing Sheets

(51) Int. Cl.
*E21B 33/04* (2006.01)
*E21B 4/00* (2006.01)

(56) References Cited

U.S. PATENT DOCUMENTS

| | | | | |
|---|---|---|---|---|
| 2001/0050185 | A1 | 12/2001 | Calder et al. | |
| 2008/0245574 | A1* | 10/2008 | Campbell | E21B 10/322 175/57 |
| 2009/0139724 | A1* | 6/2009 | Gray | E21B 23/04 166/345 |
| 2012/0125598 | A1 | 5/2012 | Godfrey et al. | |

OTHER PUBLICATIONS

Written Opinion for corresponding International App No. PCT/US2015/036171, dated Sep. 24, 2015, 11 pages.
International Preliminary Report on Patentability for the equivalent International patent application PCT/US2015/036171 dated Dec. 29, 2016.

* cited by examiner

PASSIVE PRESSURE AND LOAD BALANCING BEARING

RELATED APPLICATIONS

This application claims the benefit of U.S. Provisional Application having Ser. No. 62/013,939 filed Jun. 18, 2014, which is incorporated by reference in its entirety.

BACKGROUND OF THE DISCLOSURE

Wells are drilled on land and in marine environments for a variety of exploratory and extractive purposes. Due to the variety of purposes, the conditions experienced while producing the wells also vary greatly. The particular conditions include changes in temperature, pressure, subterranean fluids and formations, among other variables. The conditions expected during the drilling process affect the type of drilling process used to produce the wellbore. The type of drilling operation will vary with changes in the conditions. The equipment used, including the configuration of the bottomhole assembly, will also be affected by subsurface conditions.

A drilling system includes a drilling rig outside of the wellbore and a drill string with a bottomhole assembly near or at the bottom of the wellbore. The drilling rig includes a platform, a rotating table, a kelly, pressure control devices such as one or more blowout preventers and a rotating control device ("RCD"). The drilling rig stabilizes and controls the upper end of the drill string, which extends downward. The drill string includes drill pipe in segments mated together at threaded joints. The drill pipe provides force transmission and a fluid conduit down to the bottomhole assembly at the end of the drill pipe. The bottom of the drill pipe is connected to the bottomhole assembly. The bottomhole assembly has a variety of equipment and modules that enable operators to monitor and control the drilling progress. The bottomhole assembly includes components such as a drill bit, a drill motor, measurement-while-drilling equipment, logging-while-drilling equipment, and a drill collar.

During drilling, a drilling fluid is pumped from the drilling rig down the fluid conduit within the drill pipe to the bottomhole assembly. The drilling fluid passed through a fluid conduit extending through the bottomhole assembly and passes through the drill bit, producing a positive pressure at the bottom of the wellbore. The composition of the drilling fluid also changes depending on the conditions of the formation through which the wellbore will extend. Generally, however, the drilling fluid is used to lubricate and cool the drill bit while also removing drill cuttings from the wellbore. The drilling fluid flows back up the wellbore in annular gap around the drill string, carrying drill cuttings with it.

As the drilling fluid reaches the top of the drilling system, the rotating control device creates a closed circulatory path for the drilling fluid pumped into the wellbore. The RCD provides a rotatable seal between the drill string and the encasing structure, which acts as an outlet to divert the drilling fluid through a series of separators and treatment devices before being pumped back down into the wellbore to circulate through again. The RCD includes a fluid seal that contains the pressurized drilling fluid while also allowing rotation of the drill string. Bearings contained in the RCD allow rotation of part of the RCD and affect the thickness of the device structure.

BRIEF DESCRIPTION OF THE DRAWINGS

In order to describe the manner in which the above-recited and other advantages and features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings are schematic representations of concepts, at least some of the drawings may be drawn to scale. Understanding that these drawings depict only typical embodiments of the disclosure and are not therefore to be considered to be limiting of its scope, the embodiments will be described and explained with additional specificity and detail through the use of the accompanying drawings in which.

DETAILED DESCRIPTION

Figure 1:
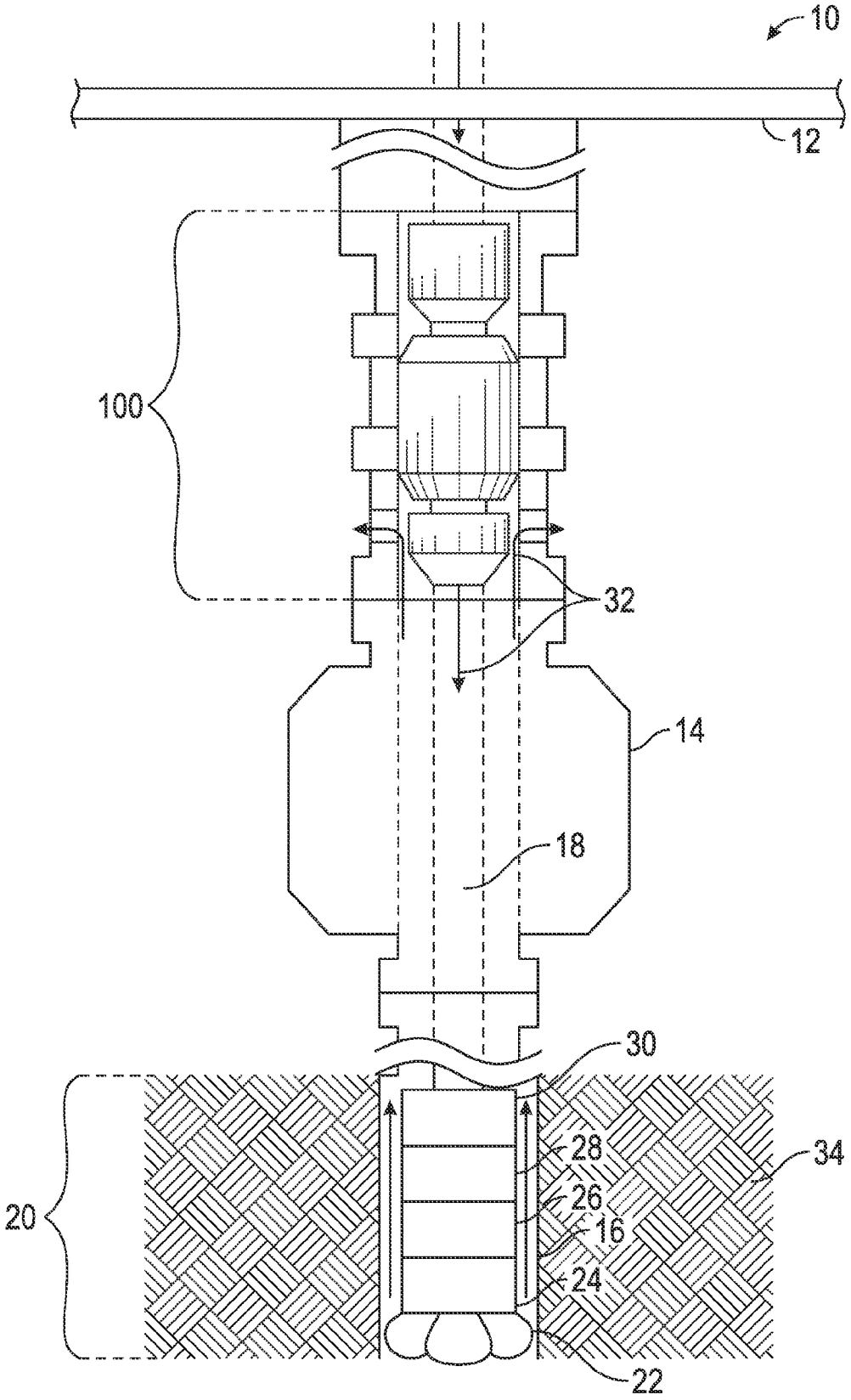
FIG. 1 illustrates a drilling system including an RCD according to the present disclosure.

One or more specific embodiments of the present disclosure will be described below. These described embodiments are examples of the presently disclosed techniques. Additionally, in an effort to provide a concise description of these embodiments, not all features of an actual implementation may be described in the specification. It should be appreciated that in the development of any such actual implementation, as in any engineering or design project, numerous implementation-specific decisions will be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

This disclosure generally relates to a rotating control device ("RCD"), system, and method for use thereof in the drilling system. However, it should be understood that the designs disclosed herein may be applicable to rotational bearings in a system with pressurized fluids, such as pneumatic or hydraulic devices, turbine engines, other non-well drilling operations, or other operations. An RCD in accordance with the present disclosure may include an outer member and an inner member, with a bearing or plurality of bearings disposed therebetween. The bearings may be operatively associated with a fluid inlet that enables a pressurized fluid to impart an input force to the bearing and pressurize a fluid therein to provide a balancing force against a weight of the RCD inner member and/or associated components.

The pressurized fluid may act on one or more pistons through one or more fluid chambers to internally compensate for variations in the fluid pressure. The fluid pressure will be generally controlled during managed-pressure drilling ("MPD") drilling operations, but variations in the fluid pressure may occur due to formation pressure changes known as "kicks." The effect of the kicks, as well as other pressure changes due to drilling considerations, may be limited by the use of pistons and fluid chambers having differing geometries. At least one embodiment of an RCD as described herein may provide a fluid bearing on which the inner member may rotate with little rotational friction by using the fluid pressure to establish the fluid bearing and/or may minimize the effect of pressure changes on the bearing thickness.

FIG. 1 shows an embodiment of a drilling system 10 containing an RCD 100 according to the present disclosure. The drilling system 10 may include a rotary table 12 above the RCD 100. The drilling system 10 may include a blowout preventer 14 below the RCD 100. In an embodiment, the blowout preventer 14 may include a stack of blowout preventers or other pressure valves to that may be closed in the event of uncontrolled pressure changes in the wellbore 16. At least one tubular 18 may extend a length of the drilling system 10 from above the rotating table 12 down to the bottomhole assembly 20. The bottomhole assembly 20 may include a drill bit 22, a drill motor 24, a drill collar 26, measurement-while-drilling equipment 28, logging-while-drilling equipment 30, or other components.

FIG. 1 also depicts the flow of drilling fluid 32 through the drilling system 10. The drilling fluid 32 may flow downward through the tubular 18 and bottomhole assembly 20. The drilling fluid 32 may exit from the drill bit 22 thereby lubricating the drill bit 22 and/or provide energy to drive the drill motor 24. The drilling fluid 32 may circulate upward within the wellbore 16 around the bottomhole assembly 20 and the tubular 18. The drilling fluid 32 may carry drilling cuttings in the wellbore 16 generated by the drilling process upward toward the RCD 100 to enable removal of material from the surrounding formation 34. The drilling fluid 32 may then flow to the RCD 100, where the RCD 100 may divert the flow outward to a closed circulatory system including separators and treatment devices (not shown in FIG. 1) by way of which the drilling fluid 32 is treated and cleaned (for example, by removing the drill cuttings from the drilling fluid 32) before the drilling fluid 32 is pumped back down the drilling system 10 and into the wellbore 16 again. The drilling fluid 32 in the wellbore 16 may be pressurized at or above the pressure of the formation fluid in the surrounding formation 34. The RCD and other pressure control devices such as a choke may be used to control the pressure of the drilling fluid 32 in the wellbore 16.

Figure 2:
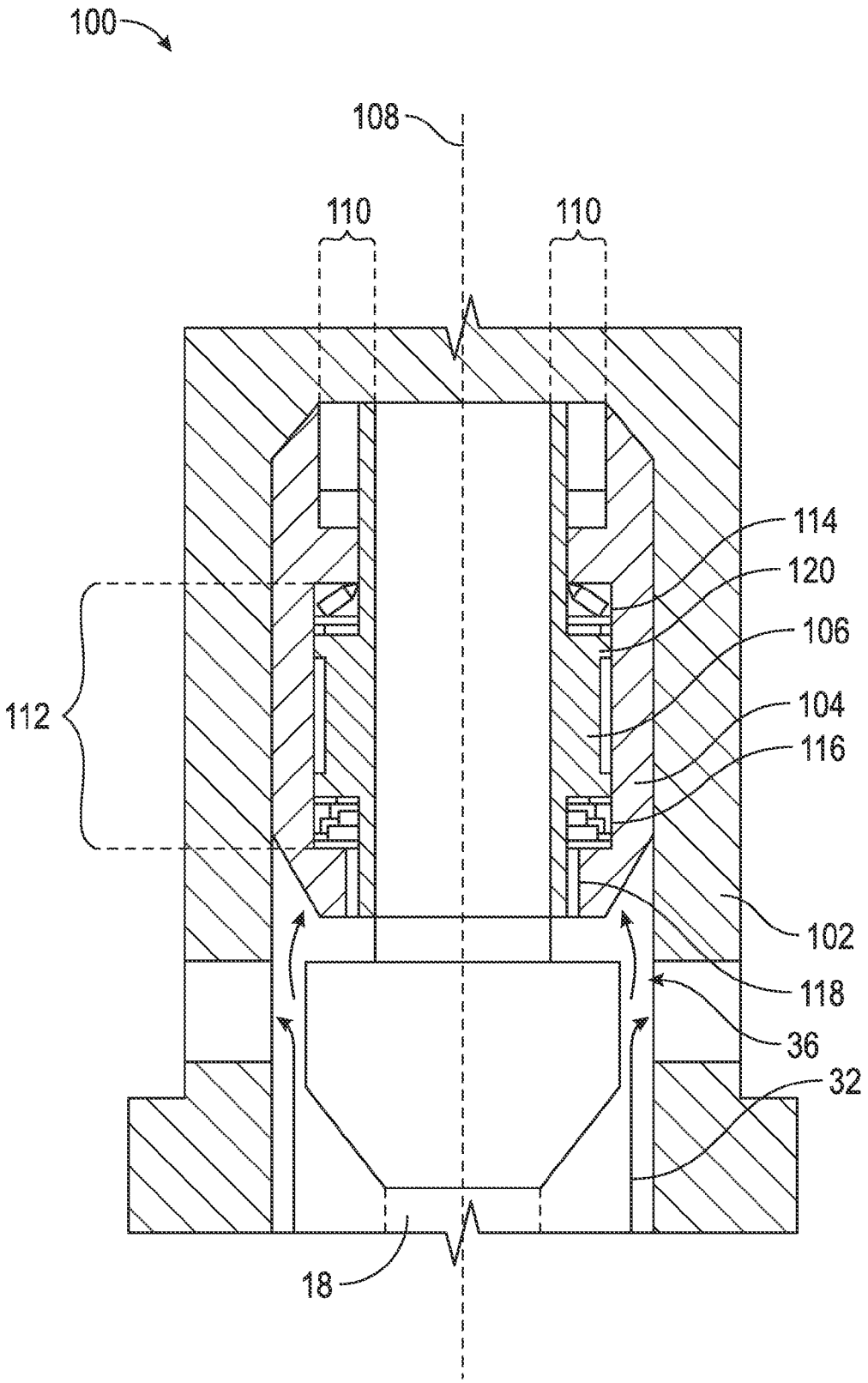
FIG. 2 illustrates a longitudinal cross-section of drilling fluid interacting with an embodiment of an RCD incorporating a fluid bearing according to the present disclosure.

FIG. 2 depicts the interaction of the drilling fluid 32 and the RCD 100. The drilling fluid 32 flows upward (i.e. around the tubular 18) and may apply a pressure to one end of the RCD housing 102 and/or bearing assembly housing 104 of the RCD 100. In some embodiments, the RCD housing 102 may be generally cylindrical, for example, having a circular transverse cross-section. In other embodiments, the RCD housing 102 may have a polygonal transverse cross-section such a square, a pentagon, a hexagon, and the like or an irregular polygon. Similarly, in some embodiments, the bearing assembly housing 104 may be generally cylindrical and have a circular transverse cross-section. In other embodiments, the bearing assembly housing 104 may have a polygonal transverse cross-section such a square, a pentagon, a hexagon, and the like or an irregular polygon.

In some embodiments, the RCD housing 102 and bearing assembly housing 104 may have similar transverse cross-sections, such that the RCD housing 102 and the bearing assembly housing 104 can mate together complementing each other. In other embodiments, the RCD housing 102 and bearing assembly housing 104 may have differing transverse cross-sections and may incorporate an additional intermediate portion (not shown) to allow the RCD housing 102 and the bearing assembly housing 104 to sufficiently mate with one another to provide a fluid seal between the RCD housing 102 and the bearing assembly housing 104. The fluid seal between the RCD housing 102 and the bearing assembly housing 104 may inhibit flow of the drilling fluid 32 therebetween. As used herein, a "fluid seal" should be understood to be a connection, either movable or stationary, between two or more components that substantially prevents the passage of fluids. A fluid seal may be at least partially due to the tolerances of the dimensions, but may also be at least partially due to the use of O-rings, elastomer coatings, polymer coatings, other coatings, other seals, or combinations thereof.

The RCD 100 may establish a region of positive pressure bounded by the RCD housing 102 and the bearing assembly housing 104 containing drilling fluid 32. The bearing assembly housing 104 may support a mandrel 106 within the bearing assembly housing 104. The mandrel 106 may be held concentrically within the bearing assembly housing 104 and/or may be configured to rotate about a common longitudinal axis 108 with the bearing assembly housing 104. The mandrel 106, may also, be generally cylindrical, having a circular transverse cross-section or may have a polygonal transverse cross-section such a square, a pentagon, a hexagon, and similar or an irregular polygon. The mandrel 106 may have any transverse cross-section such that it may rotate within the bearing assembly housing 104.

As depicted in FIG. 2, the RCD 100 may include a surrounding space 110 located between the bearing assembly housing 104 and the mandrel 106. The surrounding space 110 may be defined by the shape of the bearing assembly housing 104 and the mandrel 106. In an embodiment, the surrounding space 110 is an annular space. In other embodiments, the surrounding space may have a polygonal transverse cross-section. In some embodiments, the surrounding space 110 may have a uniform transverse cross-section along at least a part of its longitudinal length. In other embodiments, the transverse cross-section may be non-uniform across its longitudinal length.

The surrounding space 110 may contain a bearing assembly 112. The bearing assembly 112 may support the mandrel 106 within the bearing assembly housing 104 and/or may enable rotation of the mandrel 106 within the bearing assembly housing 104 or assist rotation of the mandrel 106 within the bearing assembly housing 104 by reducing friction and/or other resistances to the rotation of the mandrel 106. The bearing assembly 112 may provide a surface upon which the mandrel 106 may rotate relative to the bearing assembly housing 104 with little or no degradation of the rotational performance. For example, the bearing assembly 112 may include a superabrasive surface. The superabrasive surface may exhibit a low coefficient of friction between the superabrasive surface and another surface as well as having very high durability, allowing the bearing to rotate on that surface for long periods of time without repairs or maintenance. In the depicted embodiment, the upper bearing 114 includes roller-element bearings that may comprise a very durable material, such as the aforementioned superabrasive material and may rotate about an axis to reduce friction within the upper bearing 114.

As shown in FIG. 2 (and in greater detail in FIG. 7), lower bearing 116 may include one or more load balancing fluid bearings, which may be in fluid communication with an annular space 36 inside the bearing assembly housing 104. The pressurized drilling fluid 32 may be within the RCD housing 102 and/or the bearing assembly housing 104. The bearing assembly housing 104 includes a fluid inlet 118 on a surface. The fluid inlet 118 may allow fluid communication between the lower bearing 116 and the annular space 36 inside the bearing assembly housing 104. The drilling fluid 32 may act to pressurize the fluid bearing of the lower bearing 116 and thereby provide a fluid layer upon which the mandrel 106 may rotate based on the existing fluid pressure in the drilling system 10.

Additionally, the RCD 100 may include radial bearings 120 such as those depicted in FIG. 2. The radial bearings 120 may substantially prevent or limit transverse movement of the mandrel 106 relative to the bearing assembly housing 104. In some embodiments, the radial bearing 120 may include a superabrasive surface such as that shown in FIG. 2 to hold the mandrel 106 transversely relative to the bearing assembly housing 104 while allowing a low coefficient of friction with high durability. In other embodiments, the radial bearings may comprise a fluid bearing and/or a roller-element bearing.

The RCD 100 may incorporate a fluid bearing in the lower bearing 116 as depicted in FIG. 2. Additionally, the roller-bearing element of the upper bearing 114 may be a fluid bearing similar to that described in relation to the lower bearing 116 or may incorporate features of both a roller-element bearing and a fluid bearing together. While the fluid bearings disclosed herein will be described in relation to using the pressurized drilling fluid to pressurize the fluid within the bearing, it should be appreciated that the source of the pressurized fluid need not be the drilling fluid, but may be an independently pressurized fluid reservoir, another source, or combinations thereof.

Figure 3:
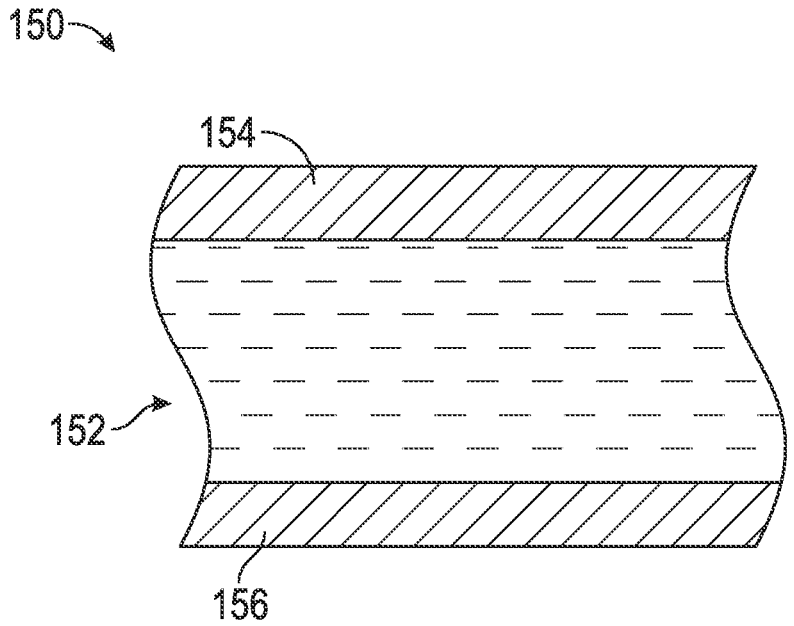
FIG. 3 schematically illustrates an embodiment of a fluid bearing.

As shown in FIG. 3, a fluid bearing 150 provides a fluid layer 152 upon which a first surface 154 is suspended relative to a second surface 156. As used herein, "suspended" should be understood to mean that the first surface is restrained from moving toward the second surface by the layer of fluid, but the first surface may not necessarily be positioned above the second surface. In some embodiments, the first surface may be suspended longitudinally proximate the second surface, while in other embodiments, the first surface may be suspended laterally proximate to the second surface.

The fluid bearing 150 may provide a fluid layer 152 with a first surface 154 and a second surface 156. The fluid forming the fluid layer is the supporting fluid or working fluid. The first surface 154 and second surface 156 may be parallel to one another or may be oriented at another angle to one another. Upon movement of the first surface 154 relative to the second surface 156, the fluid layer 152 may shear, exhibiting laminar flow within the fluid layer 152, may exhibit turbulent flow within the fluid layer 152, may exhibit other flow behavior, or combinations thereof. Turbulent flow may allow for faster movement of the first surface 154 relative to the second surface 156 and may generate less drag and less heat. However, laminar flow may result in little to no motion of the fluid layer 152 normal to the first and second surfaces 154, 156. Generally, a thinner fluid layer 152 may exhibit more laminar behavior and a thicker fluid layer 152 may exhibit more turbulent behavior. The fluid layer 152 may also exhibit a combination of laminar and turbulent behavior. The flow regime of the fluid bearing 150 also depends at least partially upon the viscosity of the fluid between the first and second surfaces 154, 156. High viscosity fluids will exhibit laminar flow at greater thicknesses than low viscosity fluids.

Figure 4:
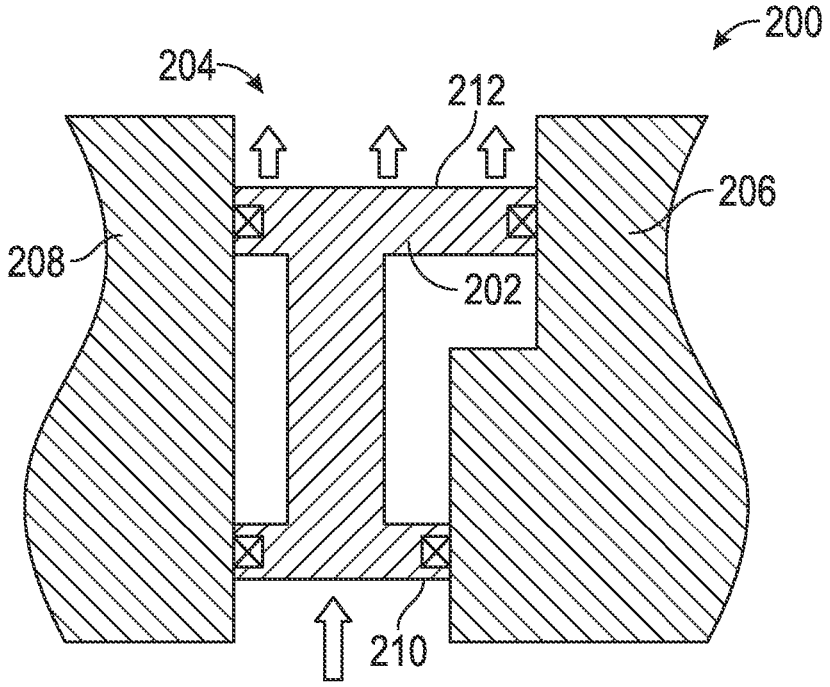
FIG. 4 illustrates an embodiment of a piston and a cylinder having two ends with different geometry.

Referring now to FIG. 4, an embodiment of a fluid bearing 200 is illustrated that may include a piston 202 disposed in an annular space 204 between an inner wall 206 and an outer wall 208. In some embodiments, the inner wall 206 may be rotationally fixed relative to the outer wall 208. In other embodiments, the inner wall 206 may be connected to the mandrel 106 and the outer wall 208 may be connected to the RCD housing 102.

The piston 202 may transmit force applied to a first surface 210 to a second surface 212 of the piston 202. The force applied to the first surface 210 will be transmitted to the second surface 212 with little to no change in the force (assuming little to no friction between the piston and the inner and outer walls 206, 208).

While the force applied to the first surface 210 will be similar to the force transmitted to the second surface 212, the relative pressures experienced by the first surface 210 and the second surface 212, absent additional forces interacting on the piston 202, will be proportional to the ratio of the surface areas of the first surface 210 and the second surface 212. By way of example, if the piston 202 transfers 10 Newtons (N) of force from the first surface 210 to the second surface 212 and the pressure experienced by the first surface 210 is 10 $N/cm^2$, the second surface 212, which may have a surface area double that of the first surface 210, as depicted in FIG. 4, applies a pressure of 5 $N/cm^2$ to a fluid on the opposite side. The piston 202 may, thereby change an input pressure proximate the first surface 210 to an output pressure proximate the second surface 212 based at least partially upon the ratio of the surface area of the first surface 210 and the surface area of the second surface 212.

In some embodiments, the ratio of the surface area of the first piston 210 and the surface area of the second piston 212 may be about 1:1.1. In other embodiments, the ratio of the surface area of the first piston 210 and the surface area of the second piston 212 may be about 1:1.2. In further embodiments, the ratio of the surface area of the first piston 210 and the surface area of the second piston 212 may be less than about 1:2. In yet other embodiments, the ratio of the surface area of the first piston 210 and the surface area of the second piston 212 may be between about 1:1.5 and about 1:2.

The piston 202 and similar pistons depicted in other embodiments may be hollow or have a generally I-beam shape in cross-section. In other embodiments, the piston may be solid. A solid piston may be less prone to deformation under stress. A hollow or generally I-beam shaped piston (such as piston 202) may allow for movement of a lubricant or coolant adjacent the piston.

Figure 5:
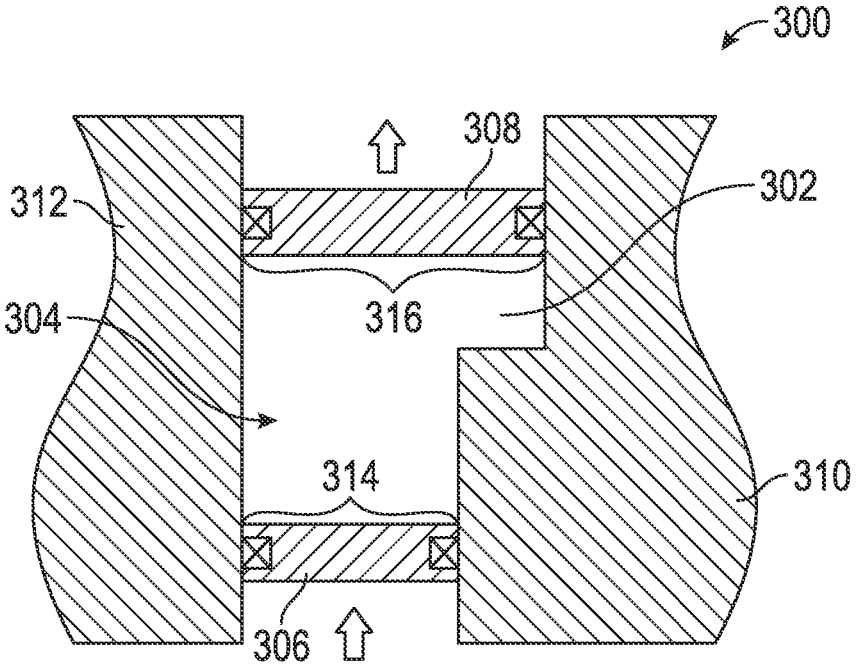
FIG. 5 illustrates an embodiment of a fluid chamber and a cylinder having two ends with different geometry.

Referring now to FIG. 5, an embodiment of a fluid bearing 300 is illustrated that may include a fluid chamber 302 containing a supporting fluid 304 therein. The supporting fluid 304 may establish a fluid pressure within the fluid chamber 302. The fluid chamber 302 may be at least partially bounded by a first movable member 306 and a second movable member 308. As shown in FIG. 5, the first movable member 306 and second movable member 308 may have different dimensions, including surface area. The dimensions of the first movable member 306 may substantially match the dimensions of at least part of the fluid chamber 302 in a complementary manner to create a fluid seal therebetween. Likewise, the dimensions of the second movable member 308 may substantially match the dimensions of at least a different part of the fluid chamber 302 in a complementary manner to create a fluid seal therebetween.

The fluid chamber 302 depicted in FIG. 5 is defined by the first movable member 306 and the second movable member 308, which each form a fluid seal with the inner wall 310 and outer wall 312, respectively. The fluid pressure of the supporting fluid 304 may increase as a force is applied to one of the movable members 306, 308. In the depicted example, a force is applied to the first movable member 306, which transmits the force to the supporting fluid within the fluid chamber 302, increasing the fluid pressure within the fluid chamber 302. The fluid pressure may be applied equally to all surfaces within the fluid chamber 302, including the entire surface area of the second movable member 308. The pressure applied to the second movable member 308 may therefore result in an increased force relative to the force applied to the first movable member 306. Similar to the first and second movable members 306, 308, however, the fluid chamber 302 may have non-uniform dimensions.

Figure 6:
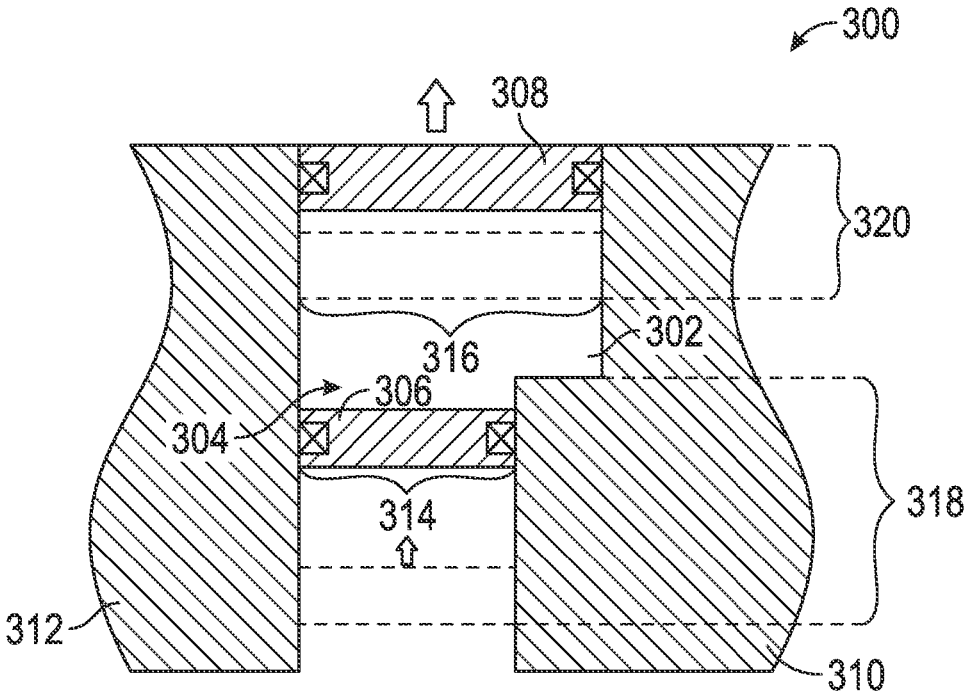
FIG. 6 illustrates the movement of the fluid chamber within the cylinder of the embodiment shown in FIG. 5.

FIG. 6 depicts an embodiment of a fluid chamber having a first end 314 (defined by the first movable member 306) having a smaller surface area than a second end 316 (defined by the second movable member 308). As the first movable member 306 moves, the second movable member 308 may move, as well. The fluid chamber 302 may change volume as the first and second movable members 306, 308 move. The fluid chamber 302 may decrease in volume as the first movable member 306 moves towards the fluid chamber 302 (i.e. upward as depicted in FIG. 6). The fluid chamber 302 may increase in volume as the second movable member 308 moves away from the fluid chamber 302 (i.e. upward as depicted in FIG. 6). The fluid chamber 302 may, similarly, increase in volume as the first movable member 306 moves away from the initial position of the fluid chamber 302 (i.e. downward as depicted in FIG. 6). The fluid chamber 302 may decrease in volume as the second movable member 308 moves towards the initial position of the fluid chamber 302 (i.e. downward as depicted in FIG. 6). The respective rates of change of the volume of the fluid chamber 302 due to a displacement in the first movable member 306 or the second movable member 308, however, may not be equal. For example, a rate of change of the volume of the fluid chamber 302 may be greater for a particular amount of displacement of the second movable member 308 than a rate of change of the volume of the fluid chamber 302 for the same amount of displacement of the smaller first movable member 306. Therefore, if the volume of the fluid chamber 302 remains constant, the first movable member 306 may experience a greater displacement than the second movable member 308.

FIG. 6 depicts an example of the displacement of the first movable member 306 and the second movable member 308 relative to an initial position for each. The first movable member displacement 318 is larger than the second movable member displacement 320. The work (the amount of energy transferred and defined as a force multiplied by a distance over which the force is applied) done on each side of the fluid chamber 302, and hence the work done by the first movable member 306 and the work done on the second movable member 308, may be substantially the same, however.

In an embodiment, the supporting fluid 304 may be a substantially incompressible fluid. In such an embodiment, the supporting fluid 304 may not absorb any of the input energy and, instead, may transfer substantially all of the input energy that moves the first movable member 306 toward the second movable member 308 and the second movable member 308 will experience an output energy substantially equivalent to that of an input energy. The input energy will be applied to the supporting fluid 304 by the first movable member 306 over the first movable member displacement 318. The output energy will be applied to the second movable member 308 by the supporting fluid 304 over the second movable member displacement 320. The work experienced by the first movable member 306 and the second movable member 308 may be substantially equal. Because the second movable member displacement 320 is less than the first movable member displacement 318, the force applied to the second movable member 308 over the second movable member displacement 320 may be greater than the force applied to the first movable member 306 over the first movable member displacement 318.

In another embodiment, the supporting fluid 304 may be a compressible fluid. In such an embodiment, the supporting fluid may store a portion of the input energy as potential energy or convert the input energy to heat, and therefore the fluid pressure in the fluid chamber 302 may increase more slowly and a displacement of the first movable member 306 may result in a smaller displacement of the second movable member 308 than in an embodiment with an incompressible fluid.

Figure 7:
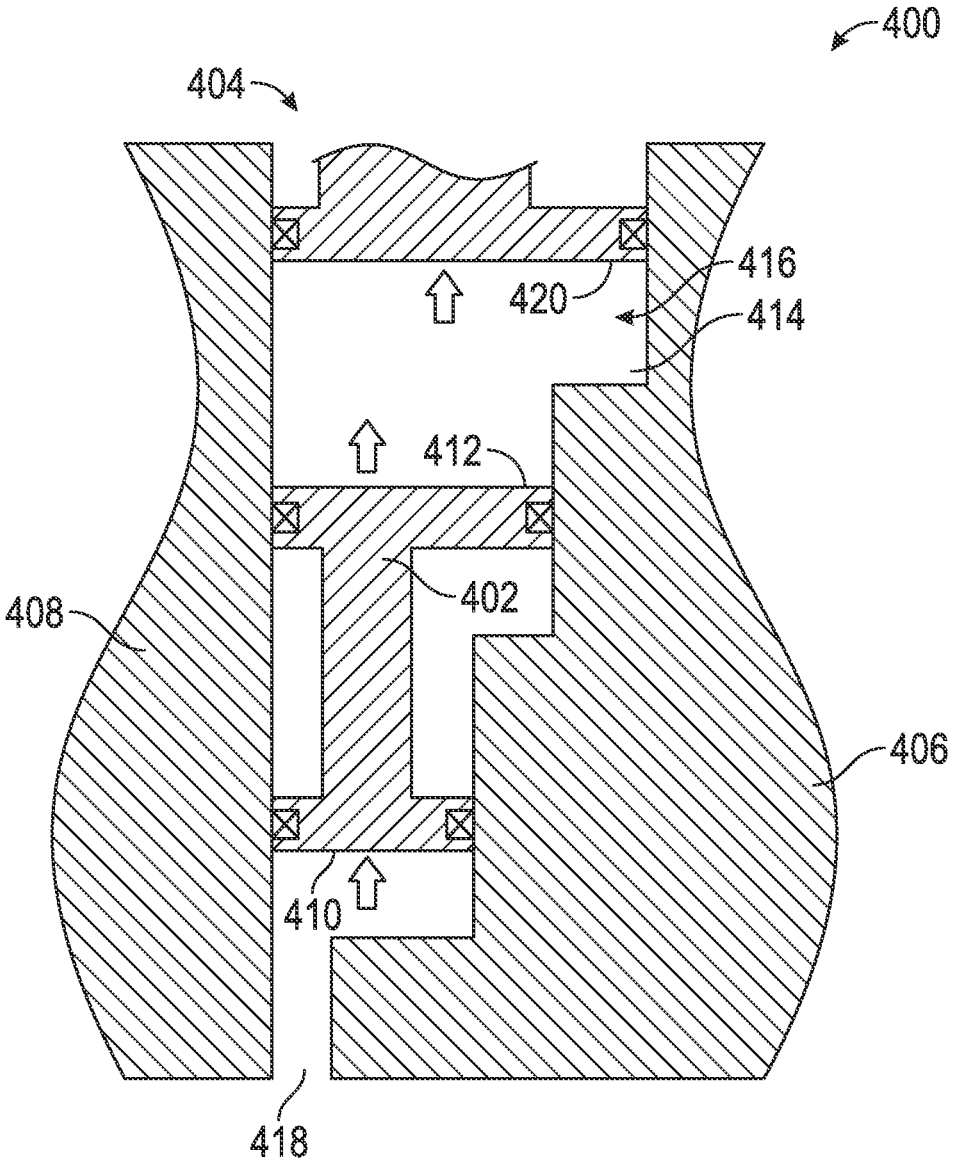
FIG. 7 illustrates a combined system of the embodiment of a piston as depicted in FIG. 4 and the embodiment of a fluid chamber as depicted in FIG. 5.

FIG. 7 depicts an embodiment of a fluid bearing 400 that includes a piston 402 and a fluid chamber 414 having a supporting fluid 416 therein. The piston 402 has a first surface 410 and a second surface 412. The second surface 412 is the first movable member of the fluid chamber 414.

A fluid bearing 400 as shown in FIG. 7 may allow an external fluid from a fluid inlet 418 to apply a force to the first surface 410 of the piston 402. In an embodiment, the external fluid may be the drilling fluid 32 of FIGS. 1 and 2. In other embodiments, the external fluid may be a pressurized fluid from a dedicated reservoir. The first surface 410 of the piston 402 may form a fluid seal with the inner wall 406 and the outer wall 408 thereby preventing introduction of the external fluid into the annular space 404 and potentially damaging the fluid bearing 400 or contaminating the supporting fluid 416. The external fluid may apply an input fluid pressure over the surface area of the first surface 410. The input fluid pressure over the first surface 410 may define an input force and the piston 402 may transmit that input force to the second surface 412 of the piston 402. The second surface 412 of the piston 402 has a surface area larger than the first surface 410 of the piston, and therefore, while the force transmitted to the second surface 412 may be substantially the same as the input force, the resultant fluid pressure in the fluid chamber 414 may be less than the input pressure experienced by the first surface 410 of the piston 402.

As the input force moves the piston 402, the second surface 412 may transmit the input force to, and thereby pressurize, the supporting fluid 416 in the fluid chamber 414, which may, in turn, apply the resultant fluid pressure over the surface area of the second movable member 420, similar to fluid bearing 300 described in relation to FIGS. 5 and 6. The resultant force on the second movable member 420 may move the second movable member 420. The displacement of the second movable member 420 may be less than the displacement of the piston 402.

A combined piston and chamber design such as that embodied in fluid bearing 400 depicted in FIG. 7 may allow the transmission energy and amplification of force from a fluid inlet 418 to a second movable member 420 or additional components associated with the second movable member 420 while producing smaller changes in location and reducing pressure of the fluids and lubricants in the fluid bearing 400. Lower pressures within a fluid bearing may result in lower maintenance and longer operating cycles, as well as allow for higher input pressures.

Figure 8:
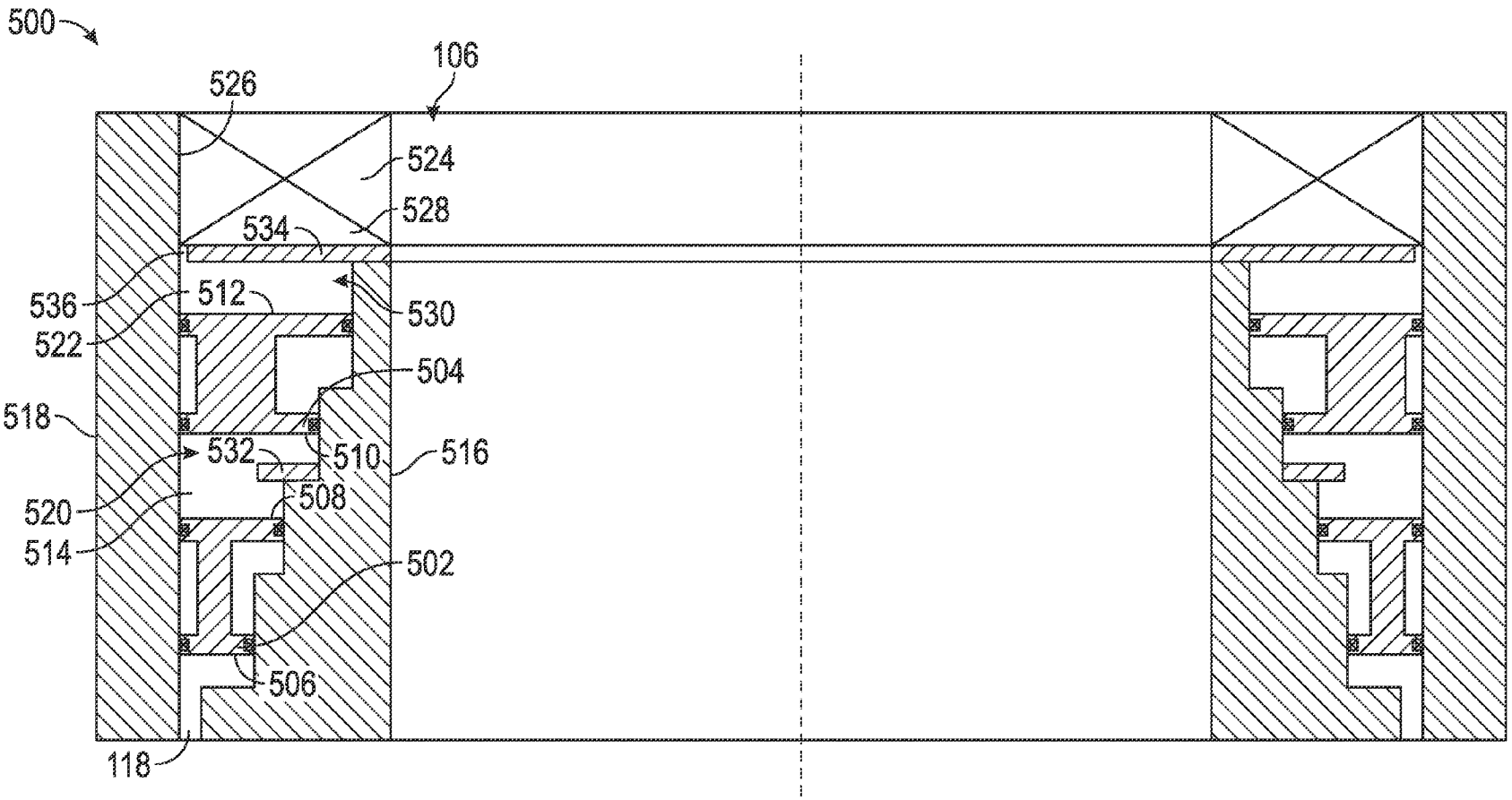
FIG. 8 illustrates an embodiment of a fluid bearing incorporating a plurality of pistons and fluid chambers in an RCD.

FIG. 8 depicts an embodiment having a plurality of pistons and a plurality of fluid chambers, which may produce a robust fluid bearing with large ranges of operating pressures. In the depicted embodiment, a fluid bearing 500 may include a first piston 502 and a second piston 504. In other embodiments, a fluid bearing may include more than two pistons. The first piston 502 and second piston 504 each have a first surface 506, 510 and a second surface 508, 512, respectively. The second surface 508 of the first piston 502 and the first surface 510 of the second piston 504 define opposing surfaces of the first fluid chamber 514. The first fluid chamber 514 is further defined by the inner wall 516 and the outer wall 518. The first fluid chamber 514 may contain a first supporting fluid 520. The first supporting fluid 520 may be an incompressible fluid and transfer substantially all of the energy imparted upon it without absorbing or dissipating a substantial amount.

The fluid bearing 500 may also include a second fluid chamber 522 defined by the second surface 512 of the second piston 504 and by a bearing 524 connected to the mandrel 106. The bearing 524 forms a fluid seal with the outer wall 518 and the fluid seal with the outer wall 518 may also be a lateral bearing 526 preventing or inhibiting lateral movement of the mandrel 106 relative to the outer wall 518. In an embodiment, the bearing 524 may be the lateral bearing 120 of the RCD 100 depicted in FIG. 2. In another embodiment, the bearing 524 may be independent of and in addition to the lateral bearing 120 of the RCD 100 depicted in FIG. 2.

The bearing 524 may have a bearing surface 528, which is the surface of the bearing 524 proximate the second surface 512 of the second piston 504. Movement of the second piston 504 may pressurize a second supporting fluid 530 in the second fluid chamber 522. The second supporting fluid 530 may apply a fluid pressure over an area of the bearing surface 528 and apply a force thereto. The bearing surface 528 may be larger in surface area than the second surface 512 of the second piston 504. The surface area differential may result in an increase in the force applied to the bearing surface 528 and bearing 524 while decreasing the displacement of the bearing surface 528 compared to the associated displacement of the second piston 504.

The fluid bearing 500 may also include one or more piston stops 532 that protrude into a fluid chamber and provide a maximum limit on the displacement of a piston. As shown in FIG. 8, the piston stop 532 may be connected to the inner wall 516 and may protrude into the first fluid chamber 514 towards the outer wall 518. The piston stop 532 may therefore act as a limit on the displacement of the first piston 502 in a first direction and a limit on the displacement of the second piston 504 in a second direction. In another embodiment, the piston stop 532 may be connected to the outer wall 518 and may protrude towards the inner wall 516. In other embodiments, the piston stop 532 may be integrally formed with the inner wall 516 or outer wall 518.

The piston stop 532 may also increase the area which a piston may contact when the fluid bearing 500 experiences little or no input force from the fluid inlet 118 and the fluid bearing 500 is not pressurized. By way of example, the second piston 504 may move downward toward the fluid inlet 118, and strike the piston stop 532. The piston stop 532 may provide a larger surface area for the second piston 504 to contact. A larger surface area may reduce the amount of torque applied to the first surface 510 of the second piston 504 as well as the body of the second piston 504 itself. The lessened amount of torque on the first surface 510 of and the body of the second piston 504 may reduce maintenance and help prevent failures of the fluid bearing 500.

Similarly, FIG. 8 illustrates a bearing stop 534 protruding into the second fluid chamber 522. The bearing stop 534 may provide a surface upon which the bearing 524 may rest when the fluid bearing 500 is not pressurized. The bearing stop 534 may comprise a superabrasive material to allow the bearing 524 to move while in contact with the bearing stop 534 and while the fluid bearing 500 is not pressurized. The bearing stop 534 may extend into the second fluid chamber 522 and may extend across almost the entire width of the second fluid chamber while allowing fluid communication through a gap 536. The gap 536 may allow the second supporting fluid 530 to apply a force to the bearing surface 528 and/or may move the bearing 524 away from the bearing stop 534.

The distance between the bearing stop 534 and the bearing surface 528 may at least partially determine the flow regime of the supporting fluid 530 in the fluid bearing 500. By way of example, when the fluid bearing 500 is pressurized by an input force in the fluid inlet 118, the bearing 524 may move away from the bearing stop 534 and reduce friction during rotation of the bearing 524 and associated mandrel 106. The supporting fluid 530 between the bearing surface 528 and the bearing stop 534 may undergo laminar flow until the input force from the fluid inlet 118 increases sufficiently to move the bearing 524 further from the bearing stop 534 to allow for turbulent flow. As mentioned in relation to FIG. 2, the RCD 100 may include upper bearings 114 that limit the longitudinal movement of the mandrel 106 such that the maximum distance between the bearing surface 528 and the bearing stop 534 may be limited.

The flow regime may be further affected by the viscosity of the supporting fluid 530 used in the fluid bearing 500. The supporting fluid 530 may include petroleum-based hydraulic fluids, phosphate-ester based hydraulic fluids, organic hydraulic fluids, other hydraulic fluids, or combinations thereof. The viscosity of the supporting fluid 530 may be affected by the temperature, as well. In some embodiments, the supporting fluid 530 may operate with interior temperatures from about 50 degrees Fahrenheit to about 250 degrees Fahrenheit (about 10 degrees Celsius to about 120 degrees Celsius). In other embodiments, the interior operating temperature may be in a range having lower and upper values that include any of about 50, 60, 70, 80, 90, 100, 110, 120, 130, 140, 150, 160, 170, 180, 190, 200, 210, 220, 230, 240, and/or 250 degrees Fahrenheit, or any value therebetween. For example, the interior operating temperature may be in a range between about 80 degrees Fahrenheit and about 150 degrees Fahrenheit, in a range between about 120 degrees Fahrenheit and about 200 degrees Fahrenheit, or in a range between about 100 degrees Fahrenheit and about 140 degrees Fahrenheit.

The flow regime may be affected by the rate of movement of the bearing stop 534 and the bearing surface 528 relative to one another. For example, a faster rate of movement may result in more turbulent flow than a slower rate of movement. In some embodiments, the fluid bearing 500 may rotate at 0 to about 200 revolutions per minute ("RPM"). In other embodiments, the fluid bearing may rotate at less than about 150 RPM. In yet other embodiments, the fluid bearing may rotate at less than about 100 RPM.

It should be understood that while the first and second pistons 502, 504 and first and second fluid chamber 514, 522 are depicted in cross-section in FIG. 8, the cross-section may represent any orientation of the fluid bearing 500. For example, the pistons 502, 504 and fluid chambers 514, 522 may be annular pistons and fluid chambers that extend contiguously around the perimeter of the fluid bearing 500. In another example, the first and second pistons 502, 504 and first and second fluid chamber 514, 522 depicted in cross-section in FIG. 8 may be part of an array of pistons and chambers spaced circumferentially around the perimeter of the of the fluid bearing 500. In some embodiments, the first piston 502 and second piston 504 extend around the perimeter of the fluid bearing 500. The first piston 502 and second piston 504 may be annular pistons having a ring-shaped cross-section. The first piston 502 and second piston 504 have any other shape to complementarily fit in the surrounding space 110 between the bearing assembly housing 104 and mandrel 106. Similarly, in some embodiments, the first fluid chamber 514 and second fluid chamber 522 may extend around the perimeter of the fluid bearing 500. The first fluid chamber 514 and second fluid chamber 522 may be annular chambers, having a ring-shaped cross-section, or may have any other shape defined by the surrounding space 110 between the bearing assembly housing 104 and the mandrel 106.

Additionally, the first piston 502 and second piston 504 depicted in FIG. 8 may depict one of an array of first pistons and second pistons. The array may be sufficient to transmit force through the fluid bearing 500. A fluid bearing 500 according to the present embodiment may have any number of first pistons 502 and second pistons 504 arranged around a perimeter of the fluid bearing 500. In an embodiment, the array of first pistons 502 may be an annular array. In another embodiment, the array of first pistons 502 may be a perimeter array that substantially follows the shape of the surrounding space 110 between the bearing assembly housing 104 and the mandrel 106. In an embodiment, the fluid bearing 500 may also include an annular array of second pistons 504. In another embodiment, the fluid bearing 500 may include an array of second pistons 504 that substantially follows the shape of the surrounding space 110 between the bearing assembly housing 104 and the mandrel 106.

The pistons and fluid chambers need not have the same angular distribution about the mandrel 106. For example, the array of first pistons 502 may contain a different quantity of first pistons 502 than the quantity of second pistons 502 in the array of second pistons 504. Additionally, the first piston 502 may be a single piston that extends around the perimeter of the mandrel 106, while the second pistons 504 may be arranged in an array around the mandrel 106. The first fluid chamber 514 may be single chamber extending around the mandrel 106 or may be an array of first fluid chambers 514 that are arranged around the mandrel 106. Similarly, the second fluid chamber 522 may be single chamber extending around the mandrel 106 or may be an array of second fluid chambers 522 that are arranged around the mandrel 106.

In at least one embodiment, a fluid bearing in accordance with the present disclosure may provide improved wear characteristics relative to a roller-element bearing assembly or a surface bearing assembly. In at least one embodiment, a fluid bearing in accordance with the present disclosure may provide an RCD with a greater ratio of passthrough diameter to RCD housing diameter. For example, a larger diameter tubular may be inserted through the bearing housing assembly and along the longitudinal axis of an RCD according the present disclosure than may be inserted through a bearing housing assembly of an RCD that incorporates a roller-element bearing assembly or surface bearing assembly. In at least one embodiment, a fluid bearing in accordance with the present disclosure may generate less heat than a roller-element bearing assembly or a surface bearing assembly. In at least one embodiment, a fluid bearing in accordance with the present disclosure may operate with less friction than to a roller-element bearing assembly or a surface bearing assembly.

Figure 9:
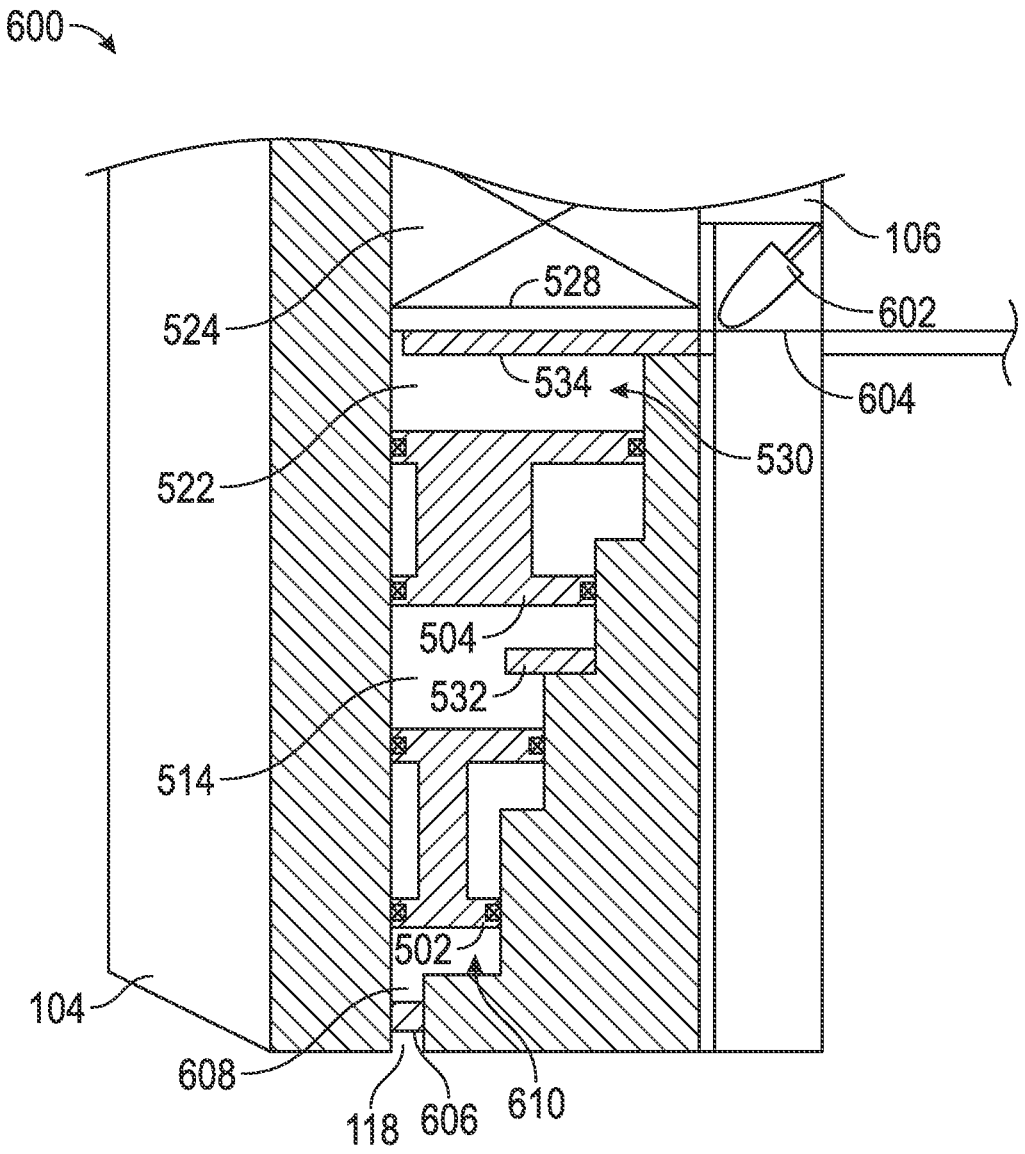
FIG. 9 illustrates an embodiment of a fluid bearing incorporating a plurality of pistons and fluid chambers used in conjunction with a roller-element bearing in an RCD.

Referring now to FIG. 9, another embodiment of a fluid bearing 600 is illustrated in conjunction with a roller-element bearing 602. A fluid bearing 600 may utilize a roller-element bearing 602 to enable low-friction rotation of the mandrel 106 relative to a bearing assembly housing 104 when the fluid bearing 600 is not pressurized. Instead of relying upon a plain bearing between the bearing surface 528 and the bearing stop 534 as described in relation to FIG. 8, the fluid bearing 600 may rest upon a roller-element bearing 602 and roller-element bearing surface 604. The roller-element bearing 602 may rotate with little friction even when the fluid bearing 600 is not pressurized, but may generate unwanted heat during normal operation.

Pressurization of the fluid bearing 600 during operation of the drilling system 10 may move the bearing 524 longitudinally away from the bearing stop 534, as described herein, as well as move the roller-element bearing 602 longitudinally away from the roller-element bearing surface 604. Moving the roller-element bearing 602 longitudinally away from the roller-element bearing surface 604 may reduce or remove a longitudinal compression force therebetween. Reduction or removal of the longitudinal compression force may reduce heat generation and wear of the roller-element bearing 602 and roller-element bearing surface 604.

The combination of the roller-element bearing 602 and the fluid layer of supporting fluid 530 between the bearing surface 528 and the bearing stop 534 may enable increased durability and lower heat generation during both pressurized and non-pressurized operation of the fluid bearing 600. A roller-element bearing 602 may generate less heat and wear down more slowly than a plain bearing with two surfaces, even a superabrasive surface, in direct contact such as the fluid bearing 500 depicted in FIG. 8 when not pressurized. A fluid bearing, such as the fluid bearing 500 depicted in FIG. 8 when pressurized, may generate even less heat and wear down more slowly than a roller-element bearing alone.

Additionally, FIG. 9 depicts a movable seal 606 that may improve durability of the fluid bearing 600, as well. The fluid bearing 600 may include an inlet fluid chamber 608 containing an inlet supporting fluid 610 in contact with the first piston 502 and the fluid inlet 118. The inlet fluid chamber 608 may transmit force from the movable seal 606 located near the fluid inlet 118 to the first piston 502. The movable seal 606 may cover and form a fluid seal with the fluid inlet 118 substantially preventing the introduction of drilling fluid or other foreign material to the interior of the fluid bearing 600. The movable seal may move longitudinally toward the first piston 502, such that the inlet fluid chamber 608 may function similarly to the fluid chamber described in relation to FIGS. 4 and 5.

The embodiment depicted in FIG. 9 shares many components with the fluid bearing 500 of FIG. 8. It should be understood, however, that any elements described in relation to any embodiment in the disclosure may be combinable with elements described in relation to any other embodiment herein. By way of example, any elements described in relation to FIG. 9 may be combinable with any of the embodiments described in relation to FIGS. 1 through 8.

While embodiments of fluid bearings have been primarily described with reference to RCDs and wellbore drilling operations, the fluid bearing may be used in applications other than the drilling of a well. In other embodiments, fluid bearing according to the present disclosure may be used outside a well or other downhole environment used for the production of natural resources. For instance, an RCD including a fluid bearing of the present disclosure may be used in a borehole used for placement of utility lines. Additionally, the fluid bearing of the present disclosure may be used in any rotary application involving pressurized fluids such as a turbine engine. Accordingly, the term "wellbore" should not be interpreted to limit tools, systems, assemblies, or methods of the present disclosure to any particular industry or field.

The terms "approximately," "about," and "substantially" as used herein represent an amount close to the stated amount that still performs a desired function or achieves a desired result. For example, the terms "approximately," "about," and "substantially" may refer to an amount that is within less than 10% of, within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

Although the preceding description has been described herein with reference to particular means, materials and embodiments, it is not intended to be limited to the particulars disclosed herein; rather it extends to all functionally equivalent structures, methods and uses, such as are within the scope of the appended claims.

What is claimed is:

1. An apparatus comprising:

an outer member;

an inner member disposed concentrically within the outer member;

a surrounding space between the inner member and outer member;

a fluid inlet in fluid communication with the surrounding space;

a bearing connected to the inner member and disposed in the surrounding space;

a first piston disposed in the surrounding space between the fluid inlet and the bearing, the first piston having a first end and a second end with the first end being longitudinally proximate the fluid inlet; and a supporting fluid located in a fluid chamber between a surface of the second end of the first piston and a surface of the bearing, wherein the fluid chamber is defined by the outer member, the inner member, the surface of the second end of the first piston and the surface of the bearing, wherein the support fluid in the fluid chamber is in direct contact with the surface of the second end of the first piston and the surface of the bearing, wherein the supporting fluid is configured to transmit force from the second end of the first piston to the surface of the bearing.

2. The apparatus of claim 1, wherein the apparatus comprises a fluid seal between the inner member and outer member.

3. The apparatus of claim 1, wherein the first end of the first piston and the second end of the first piston have different surface areas.

4. The apparatus of claim 1, further comprising an axial bearing operationally associated with the bearing.

5. The apparatus of claim 1, further comprising a second piston disposed in the surrounding space, the second piston having a first end and a second end with the second end of the second piston being longitudinally proximate the first end of the first piston.

6. The apparatus of claim 5, wherein the first end of the second piston and second end of the second piston having different surface areas.

7. The apparatus of claim 1, wherein the first piston surrounds the inner member.

8. The apparatus of claim 1, wherein the apparatus is configured to have a drill string disposed therethrough.

9. An apparatus comprising:

a cylindrical outer member;

a cylindrical inner member disposed concentrically within the cylindrical outer member;

an annular space between the cylindrical inner member and cylindrical outer member;

a fluid inlet in fluid communication with the annular space;

an annular bearing connected to the cylindrical inner member and disposed in the annular space, the annular bearing having a bearing surface disposed in the annular space;

a piston disposed in the annular space between the fluid inlet and the annular bearing, the piston having a first end and a second end with the first end being longitudinally proximate the fluid inlet and the second end being longitudinally proximate the annular bearing, wherein the bearing surface of the annular bearing disposed in the annular space faces the second end of the piston; and a supporting fluid configured to transmit force from the second end of the piston to the bearing surface of the annular bearing, wherein a surface area of the bearing surface directly facing the second end of the piston is greater than a surface area of the second end of the piston.

10. The apparatus of claim 9, wherein the first end of the piston and the second end of the piston have different surface areas.

11. The apparatus of claim 9, wherein the piston is a first piston and further comprising:

a second piston disposed in the annular space between the first piston and the bearing surface, the second piston having a first end and a second end with the first end of the second piston being longitudinally proximate the second end of the first piston and the second end of the second piston being longitudinally proximate the bearing surface;

a first fluid chamber disposed in the annular space between the second end of the first piston and the bearing surface; and a second fluid chamber disposed in the annular space between the second end of the second piston and the bearing surface.

12. The apparatus of claim 11, wherein the surface area of the first end of the first piston is greater than the surface area of the second end of the second piston.

13. The apparatus of claim 11, wherein the first end of the second piston and the second end of the second piston have different surface areas.

14. The apparatus of claim 9, further comprising a piston stop disposed in the annular space and connected to the cylindrical inner member.

15. An apparatus comprising:

a cylindrical outer member;

a cylindrical inner member disposed concentrically within the cylindrical outer member;

an annular space between the cylindrical inner member and cylindrical outer member;

a fluid inlet in fluid communication with the annular space;

an annular bearing connected to the cylindrical inner member and disposed in the annular space, the annular bearing having a bearing surface disposed in the annular space;

a first piston disposed in the annular space, the first piston having a first end and a second end with the first end of the first piston being longitudinally proximate the fluid inlet and the second end of the first piston having a surface area greater than a surface area of the first end of the first piston;

a second piston disposed in the annular space, the second piston having a first end and a second end with the first end of the second piston being longitudinally proximate the first piston and the second end of the second being longitudinally proximate the bearing surface disposed in the annular space, wherein the surface area of the first end of the second piston is greater than a surface area of the second end of the first piston;

a first fluid chamber disposed in the annular space and defined by the outer member, the inner member, the second end of the first piston and the first end of the second piston;

a first supporting fluid in the first fluid chamber and configured to transmit force from the second end of the first piston to the first end of the second piston;

a second fluid chamber disposed in the annular space and defined by the outer member, the inner member, the second end of the second piston and the bearing surface disposed in the annular space; and a second supporting fluid in the second fluid chamber and configured to transmit force from the second end of the second piston to the bearing surface, wherein a surface area of the bearing surface is greater than a surface area of the second end of the second piston.

16. The apparatus of claim 15, further comprising a fluid inlet in fluid communication with the annular space.

17. The apparatus of claim 16, wherein a radial cross-sectional area of the fluid inlet has a surface area less than a surface area of the first end of the first piston.

18. The apparatus of claim 16, further comprising a movable seal proximate the fluid inlet and configured to prevent contamination of the annular space.

19. The apparatus of claim 15, further comprising a bearing stop disposed in the annular space and connected to the cylindrical inner member and protruding into the second fluid chamber.

* * * * *